US009127214B2

(12) United States Patent
Cheng et al.

(10) Patent No.: US 9,127,214 B2
(45) Date of Patent: Sep. 8, 2015

(54) FUEL DESULFURIZATION METHOD

(71) Applicants: Shun-Sheng Cheng, Yi-Lan County (TW); Teh-Jung Lin, Yi-Lan County (TW)

(72) Inventors: Shun-Sheng Cheng, Yi-Lan County (TW); Teh-Jung Lin, Yi-Lan County (TW)

(73) Assignees: Shun-Sheng Cheng, Yi-Lan, Yi-Lan County (TW); Lin Teh-Jung, Yi-Lan, Yi-Lan County (TW)

( * ) Notice: Subject to any disclaimer, the term of this patent is extended or adjusted under 35 U.S.C. 154(b) by 162 days.

(21) Appl. No.: 13/760,009

(22) Filed: Feb. 5, 2013

(65) Prior Publication Data

US 2014/0284251 A1 Sep. 25, 2014

Related U.S. Application Data

(60) Provisional application No. 61/595,653, filed on Feb. 6, 2012.

(51) Int. Cl.

| | |
|---|---|
| ***C10G 27/12*** | (2006.01) |
| ***C10G 27/14*** | (2006.01) |
| ***C10G 27/04*** | (2006.01) |
| ***C10G 53/14*** | (2006.01) |

(52) U.S. Cl.

CPC ..... *C10G 27/12* (2013.01); *C10G 27/04* (2013.01); *C10G 27/14* (2013.01); *C10G 53/14* (2013.01)

(58) Field of Classification Search

CPC ..... C10G 27/00; C10G 27/02; C10G 27/04; C10G 27/06; C10G 27/08; C10G 27/10; C10G 27/12; C10G 27/14; C10G 29/02; C10G 29/20; C10G 53/00; C10G 53/02; C10G 53/08; C10G 53/10; C10G 53/14

USPC ..... 208/208 R, 219–225, 236, 237, 240, 208/245, 250, 189–196, 204–207

See application file for complete search history.

(56) References Cited

U.S. PATENT DOCUMENTS

| | | | | |
|---|---|---|---|---|
| 5,310,479 | A * | 5/1994 | Audeh | 208/219 |
| 7,758,745 | B2 | 7/2010 | Cheng | |
| 2003/0085156 | A1* | 5/2003 | Schoonover | 208/230 |
| 2004/0154959 | A1* | 8/2004 | Schoebrechts et al. | 208/196 |
| 2006/0108263 | A1* | 5/2006 | Lin et al. | 208/219 |
| 2009/0236266 | A1* | 9/2009 | Cheng | 208/213 |
| 2011/0042318 | A1* | 2/2011 | Painter et al. | 210/664 |
| 2011/0155638 | A1* | 6/2011 | Bhattacharyya et al. | 208/88 |

(Continued)

FOREIGN PATENT DOCUMENTS

| | | | |
|---|---|---|---|
| CN | 1226390 | C | 11/2005 |
| CN | 101153225 | A | 4/2008 |

(Continued)

*Primary Examiner* — Prem C Singh
*Assistant Examiner* — Brandi M Doyle
(74) *Attorney, Agent, or Firm* — Winston Hsu; Scott Margo

(57) ABSTRACT

A fuel desulfurization method where in the step (a), a fuel is oxidized by adding an ionic liquid, an oxidant, and an acid catalyst. In the step (b), the oxidized fuel is mixed with a desulfurization agent to form a desulfurized fuel. In the step (c), the ionic liquid is recycled. In the recycling step, a first solution is added into the ionic liquid. Then, a second solution is added into the ionic liquid to form a second solution phase and an ionic liquid phase. The second solution phase is separated from the ionic liquid phase. The first solution, the oxidant and the acid catalyst are removed from the remained ionic liquid phase to form a recycled ionic liquid.

18 Claims, 5 Drawing Sheets

(56) References Cited

U.S. PATENT DOCUMENTS

| | | | | |
|---|---|---|---|---|
| 2011/0203972 | A1* | 8/2011 | Gargano et al. | 208/236 |
| 2011/0215052 | A1* | 9/2011 | Guzman Lucero et al. | 210/724 |
| 2011/0233113 | A1* | 9/2011 | Koseoglu et al. | 208/97 |

FOREIGN PATENT DOCUMENTS

| | | | |
|---|---|---|---|
| CN | 101934218 | A | 1/2011 |
| CN | 102585888 | A | 7/2012 |

* cited by examiner

FUEL DESULFURIZATION METHOD

CROSS REFERENCE TO RELATED APPLICATIONS

This application claims the benefit of priority of U.S. Provisional Application No. 61/595,653, filed on Feb. 6, 2012, which is incorporated herein by reference.

BACKGROUND OF THE INVENTION

1. Field of the Invention

The present invention relates to a fuel desulfurization method, and more particularly, to a fuel desulfurization method that uses a recycled ionic liquid.

2. Description of the Prior Art

Diesel fuel and gasoline are two of the main transportation fuels in use today. Diesel engines typically have great fuel mileage, but diesel fuel is typically derived from crude oil, which often contains sulfur. Therefore, the benefit of high fuel mileage is often offset by increased emissions. Many hybrid cars today running on gasoline can get 50 miles a gallon, which is comparable to what a diesel car can get. Unfortunately, diesel cars burn diesel fuel that typically produces more emissions. What the world desperately needs today is clean burning diesel to avoid greenhouse gas emissions and to protect the environment. Although there have been improvements in diesel engine technology and emissions technology, high sulfur content in diesel still creates pollution.

In 2006, as part of the Clean Air Act, the Environmental Protection Agency (EPA) passed a legislation to limit the sulfur content of roadway diesel fuels to 15 ppm by 2010. This regulation was developed to reduce the negative impact of $SO_X$ emissions on the environment. $SO_X$ is responsible for acid rains, and is a main component of the industrial smog. However, ultra low sulfur diesel (ULSD) fuel production is currently hampered by inefficient desulfurization technologies that have not changed much in decades.

The current commercial technology for removing sulfur compounds from petroleum fuels is the hydrodesulfurization (HDS). The hydrodesulfurization process typically requires a liquid gas mixture with temperatures ranging from 300 to 400° C. Hydrogen gas is required for the hydrodesulfurization. The high temperature and the high pressure increase the costs, the processing sites sizes and can be explosive. Furthermore, some of the gas and waste heat of the system is lost, which also creates environmental pollution. The process also becomes increasingly inefficient when producing ULSD (15 ppm) fuel, since the production of ULSD (15 ppm) fuel instead of LSD (500 ppm) fuel requires an additional hydrogen consumption of 25 to 45 percent.

Therefore, there is a need for a fuel desulfurization process that is less polluting, more efficient and cost effective.

SUMMARY OF THE INVENTION

The present invention therefore provides a novel fuel desulfurization method to meet the current requirements.

According to one embodiment, a fuel desulfurization method is provided. In the step (a), a fuel is oxidized by adding an ionic liquid, an oxidant, and an acid catalyst. In the step (b), the oxidized fuel is mixed with a desulfurization agent to form a desulfurized fuel. In the step (c), the ionic liquid are recycled. In the recycling step, a first solution is added into the ionic liquid. Then, a second solution is added into the ionic liquid to form a second solution phase and an ionic liquid phase. The second solution phase is separated from the ionic liquid phase. The first solution, the oxidant and the acid catalyst are removed from the remained ionic liquid phase to form a recycled liquid phase.

The present invention provides a more efficient and cost effective fuel desulfurization method which includes various improved features, such as using a non-mechanical mixer, a recycled ionic liquid, a modified oxidant concentration and a modified acid catalyst.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
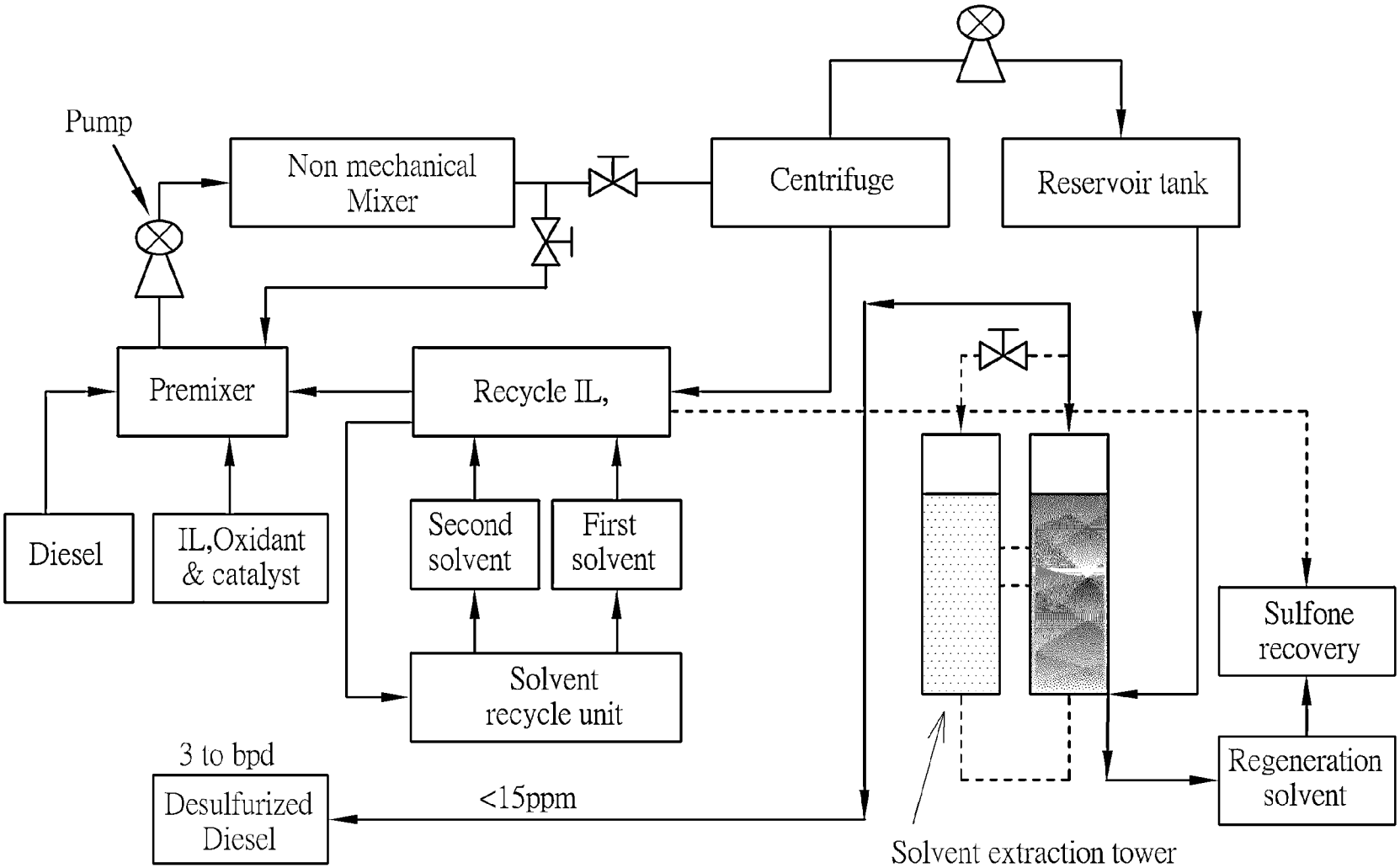
FIG. 1 shows a block diagram of a continuous flow system.

To provide a better understanding of the presented invention, preferred embodiments will be described in detail. The preferred embodiments of the present invention are illustrated in the accompanying drawings with numbered elements.

The present invention modified desulfurization method comprises three parts. The first part involves oxidizing fuel with an ionic liquid, an oxidant, and an acid catalyst. In the second part, the thiophene in the fuel is desulfurized by a solid catalyst. In the third part, the remaining ionic liquid is recycled.

In order to oxidize the thiophene in the fuel, which is in an organic phase, the first part includes a phase transfer catalysis (PTC) reaction. The PTC reaction includes two significant stages: (1) a rapid ion exchange between the catalyst and the salt during the aqueous phase and (2) a rate-determining step in the organic phase. In the present invention, the PTC reaction is achieved by adding an ionic liquid, an oxidant and an acid catalyst into the fuel simultaneously.

The fuel can be of any type of fuel oils with different sulfur contents, for example, fuel oils come in several grades of lightness, and purity, ranging from gasoline and aviation fuel all the way to Bunker C oil, which is the thick black residual after all other products have been removed from crude. In one embodiment, the fuel can be gasoline, paraffin or diesel oil, for example, a diesel fuel with a sulfur content of 8,100 ppm (Valley Oil) from Golden Eagle Oil Refinery, INC. or a marine logistic fuel with a sulfur content of 740 ppm (JP-5) from Long Beach, Navy, but not limited thereto. The diesel fuel can include any type of sulfur containing compounds such as thiophene (T), 2-methyl thiophene (2MT), 2-ethyl thiophene (2ET), benzothiophene (BT), 2-methyl benzothiophene (2MBT), dibenzothiophene (DBT), 4,6-dimethyl dibenzothiophene (4,6-DMDBT), but not limited thereto.

The oxidant is used to bring oxygen atoms to the sulfur in mercaptans (thiols), sulfides, disulfides or other organic sulfur (OCS) such as thiophene (Ts), benzothiophene (BTs), or dibenzothiophene (DBTs) to form sulfoxides or sulfones. In one embodiment, the oxidant includes hypohalite compounds, chlorite, permanganate salts, ammonium cerium (IV) nitrate, hexavalent chromium compounds, peroxide compounds, Tollen's Reagent, sulfoxides, persulfuric acid, oxygen or ozone. Each one of these has a different active oxygen percentage and different byproducts are produced. In one preferred embodiment, the oxidant is hydrogen peroxide ($H_2O_2$) and the concentration thereof is about 10 wt % to 50 wt %. In one preferred embodiment, a concentration greater than 30 wt %, for example, 30 wt % to 50 wt % is used because it provides the best desulfurization efficiency.

The ionic liquid can be of any type of ionic solvent, like any normal salt, and can produce cations and anions in the liquid phase. In one embodiment, the ionic liquid contains nitrogen containing organic cations and inorganic anions, and preferably the salts have a melting temperature lower than room temperature, so as to keep it liquid at room temperature. For example, the ionic liquid can be Tri-Methylammonium Chloroaluminate (TMAC-$AlCl_3$), 1-Ethyl-3-Methylimidazolium Tetrafluoroborate ([EMIM][$BF_4$]), 1-Butyl-3-Methylimidazolium Hexafluorophosphate ([BMIM][$PF_6$]), or 1-Butyl-3-Methylimidazolium Tetrafluoroborate ([BMIM][$BF_4$]). For large scale production, 1-Butyl-3-Methylimidazolium Octyl Sulfate ([BMIM][$OcSO_4$]) or 1-Ethyl-3-Methylimidazolium Ethyl Sulfate ([EMIM][$EtSO_4$]) are available. In another embodiment, a solid type ionic liquid can be used, such as 1,2,3-Trimethylimidazolium methyl sulfate, 1,2,4-Trimethylpyrazolium methylsulfate, 1-Ethyl-2,3-dimethylimidazolium ethyl sulfate, 1-Ethyl-3-methylimidazolium methanesulfonate, or 1,3-Dimethylimidazolium methyl sulfate. The solid type ionic liquid can be melted in hot water before mixing it into the fuel.

The acid catalyst can be any kind of acid, but preferably an organic acid. In one embodiment, the acid catalyst comprises acetic acid, tri-fluoro acetic acid, tri-chloro acetic acid. The acid catalyst can contain a mixture of the above acid to obtain a better catalytic ability. For example, the acid catalyst comprises 20 wt % tri-fluoro acetic acid and 80 wt % acetic acid. In another embodiment, the acid catalyst comprises 20 wt %-50 wt % tri-fluoro acetic acid, 10 wt %-30 wt % tri-chloro acetic acid, and 40 wt %-60 wt % acetic acid, for instance, 30 wt % tri-fluoro acetic acid, 20 wt % tri-chloro acetic acid and 50 wt % acetic acid.

It is worth noting that the present invention does not require adding any phase transfer agent (PTA). Compared to conventional arts that require a PTA, such as Tetraoctylammonium fluoride (TOAF) or Tetraoctylammonium chloride (TOAC), no additional PTA is required in the oxidant agent, thereby reducing the manufacturing costs. Another salient feature of the present invention is that there is no need to perform a ultrasonic stirring or a stir bar to mix the fuel, the oxidant, the ionic liquid and the acid catalyst; the desulfurization efficiency in the present invention can be similar to or even greater than that of conventional arts using ultrasonic stirring.

To summarize the first step, a fuel having sulfur is send to a container with an acid catalyst containing 30% tri-fluoro acetic acid (TFA), 20% tri-chloro acetic acid (TCA), and 50% acetic acid, 50% hydrogen peroxide oxidant, and an ionic liquid. No PTA and no ultrasonic stirring are used. Table 1 shows an efficient protocol condition of the oxidative desulfurization method.

TABLE 1

Efficient protocol condition of the oxidative desulfurization method

| | |
|---|---|
| OSC/toluene solution | 5 grams |
| 50% $H_2O_2$ | 10 grams |
| [EMIM][$EtSO_4$] | 5 grams |
| 30% TFA, 20% TCA, 50% acetic acid | 5 grams |
| Reaction temperature | 30-50° C. |

The second step is a desulfurization of thiophene via a solid catalyst, such as alumina or acetonitrile with microporous crystalline titanium silicates. After the first step and the second step, 99.9% of the sulfur in the fuel is removed. Table 2 shows the desulfurization efficiency of the oxidative desulfurization method on fuels, wherein model fuels such as BP#6, JP-5, F-76 and Valley Oil are presented. As shown in Table 2, the sulfur removal efficiency can reach to 99.9%, showing a great desulfurization ability.

TABLE 2

Desulfurization efficiency of the oxidative desulfurization method on fuels

| fuel | Original (ppm) | After oxidation (ppm) | Sulfur removal (%) |
|---|---|---|---|
| BP#6 | 70 | 0 | 100 |
| JP-5 | 740 | 0 | 100 |
| F-76 | 4,200 | 0 | 100 |
| Valley oil | 8,110 | 6 | 99.9 |

The third step of the method of the present invention is to recycle the ionic liquid. The recycling method in the present invention comprises adding a first solution such as deionized water into the ionic liquid with a ratio about 1:1 to 1:6 so as to precipitate parts of organic sulfur (OCS) in the fuel. After adding the first solution, an orange precipitate containing OCS is removed away by a centrifugation. About 90% OCS is removed in this step.

A second solution is then added into the ionic liquid. A ratio of ionic liquid to the second solution can be chosen between 1:1, 1:2, 1:5, 1:10, or 1:20 to completely extract the OSC from the ionic liquid. To meet the extraction requirement, the second solution contains the two following features; first, the solvent must be immiscible with the ionic liquid—i.e. the sulfone and the ionic liquid can be easily separated; then, it can extract (or dissolve) the sulfone from the ionic liquid. In one embodiment, the second solution includes 1-butanol, chloroform, chlorobenzene, diethyl ether, ethyl acetate, heptane, hexane, triethyl amine or toluene, but is not limited thereto. In one preferred embodiment, the second solution is chloroform or ethyl acetate because the melting point thereof is relatively low (chloroform: 61° C.; ethyl acetate: 77° C.) so they are easy to be removed in the subsequent steps. By adding the second solution, a second solution phase and an ionic liquid phase are formed. The OCS in the ionic liquid is extracted into the second solution phase, and the second solution phase is separated from the ionic liquid phase by a reparatory funnel for example. The ionic liquid phase is subjected to a distillation process to remove away the water (first solution), the oxidant and the acid catalyst so the recycled ionic liquid can be obtained. In one embodiment, three cycles of extraction can reduce the OCS content below the HPLC detective level. The recycled ionic liquid is mixed with new fuel, new acid catalyst and new oxidant (if required) to perform the oxidation reaction described in the first part.

Figure 2:
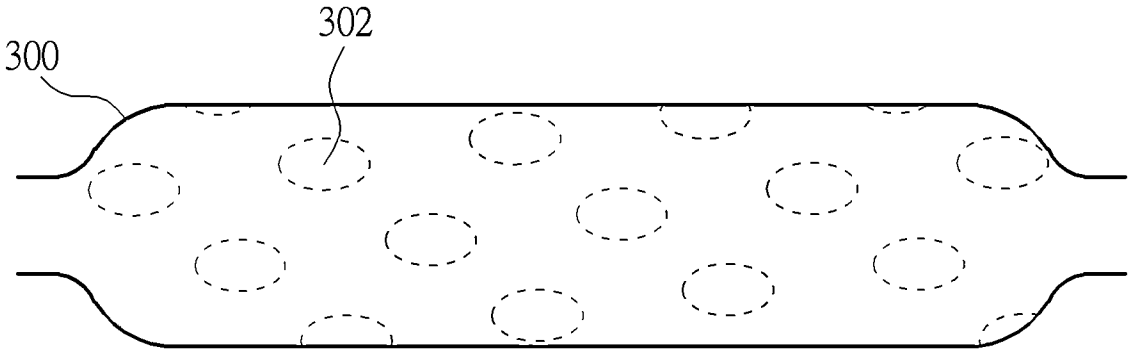
FIG. 2 and FIG. 3 show schematic diagrams of a non-mechanical mixer of the present invention.
Figure 3:
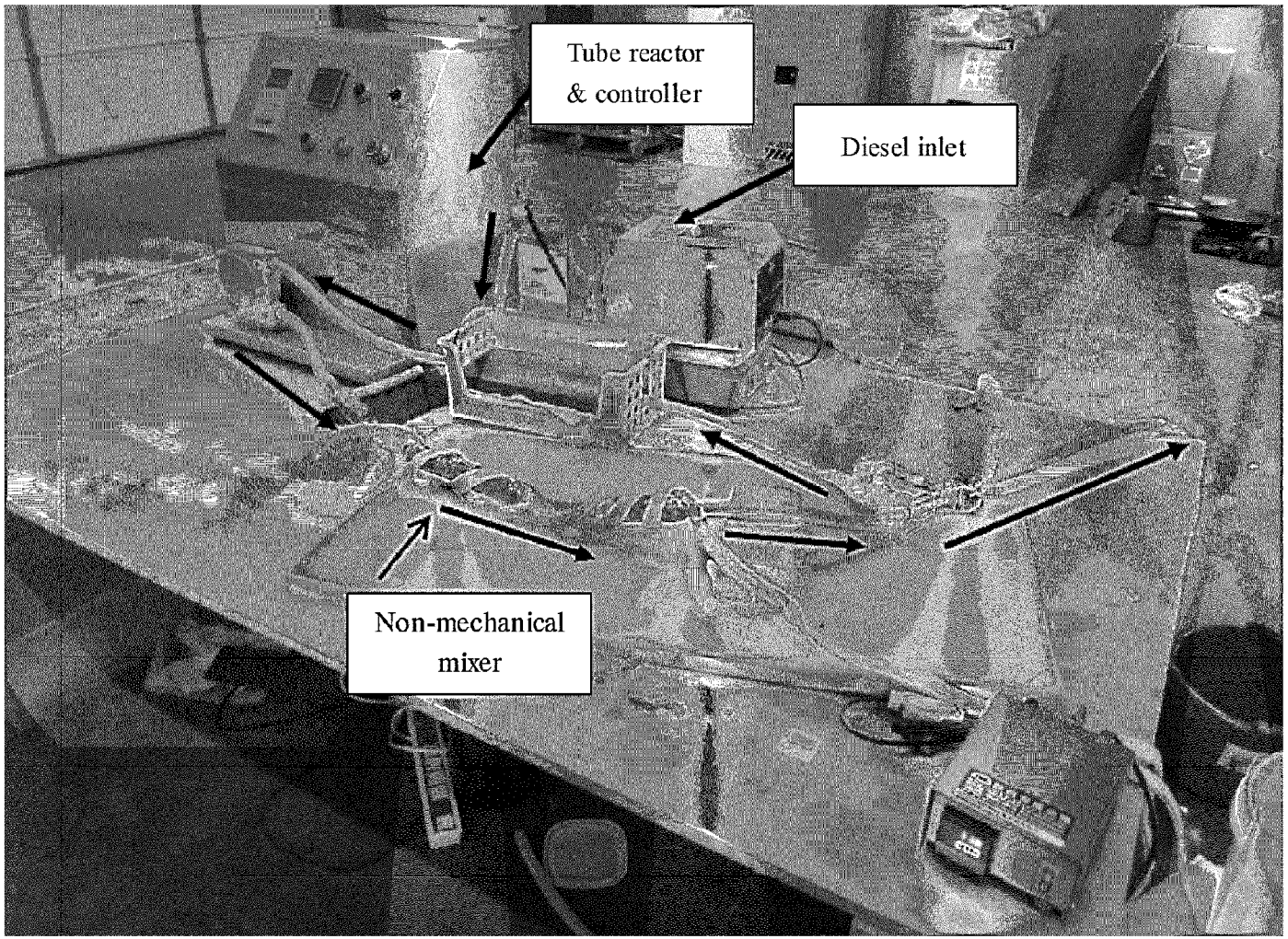

FIG. 1 shows a block diagram of a continuous flow system. In the continuous flow system, an ionic liquid, an oxidant and a catalyst are introduced into the pre-mixer. After the pre-mixer mixes the blend of ingredients, the vacuum pump pumps the mixture to a non-mechanical mixer. FIG. 2 and FIG. 3 show schematic diagrams of the non-mechanical mixer in the present invention. As shown in FIG. 2, the non-mechanical mixer is a static in-line mixer which contains a hollow tube 300 with a plurality of protrusions 302 penetrating into the tube to form an uneven inner surface. The flowed fuel, ionic liquid, oxidant and catalyst can be mixed so the oxidation of the fuel can be enhanced by the uneven inter surface, since a larger reaction surface is provided for the reaction and thereby achieving an efficient mixing strength. Consequently, the non-mechanical mixer does not require a driving power. No mechanical mixer such as ultrasonic stirring is required in the system. In one embodiment, as shown in FIG. 3, more than one in-line mixer can be connected in series to further enhance the oxidation efficiency.

The non-mechanical mixer then sends a portion back to the pre-mixer and a portion to the separator, such as a centrifuge. The centrifuge separates the ionic liquid, the catalyst and a part of the oxidant for recycling into the pre-mixer. As shown in FIG. 1, the first solution and the second solution are added in sequence to recycle the ionic liquid, as described above. The recycled ionic liquid is introduced into the pre-mixer to react with fresh fuel. In some cases, fresh ionic liquid, oxidant or catalyst can be supplied into the pre-mixer if required.

On the other hand, the centrifuge sends the remaining part without ionic liquid to the reservoir tank. The reservoir tank then sends its product to the Fluidized bed reactor (FBR). A fluidized bed reactor typically comprises a packed bed and a stirred tank with substrate entering at the bottom of the tank and removing product from the top of the tank. The FBR contains the desulfurization agent such as alumina to desufurize the oxidized fuel. The FBR desulfurization agent can be recovered and regenerated. After passing through the FBR, the final desulfurized fuel is output.

As shown above, the present invention provides a fuel desulfurization method using a non-mechanical mixer and recycled ionic liquid. Compared to conventional arts using ultrasonic stirring or other power-required mechanical, the present method without mechanical stirring can achieve superior desulfurization efficiency. Table 3 shows the desulfurization rate according to different embodiments of the present invention.

TABLE 3

Desulfurization rate of the oxidative desulfurization method on fuels.

| | Conventional | Comparative embodiment | | |
|---|---|---|---|---|
| | 1 | 2 | 3 | 4 |
| Diesel Valley oil (8100 ppm) | 5 g | 50 g | 50 g | 50 g |
| Oxidant ($H_2O_2$) | 5 g 30% | 10.5 g 30% | 7.3 g 50% | 5.1 g 50% |
| Ionic liquid ([EMIM][$EtSO_4$]) | 5 g | 5 g | 5 g | 5 g |
| Acid catalyst | 3 g 80% acetic acid 20% TFA | 8 g 50% acetic acid 50% TFA | 8 g 50% acetic acid 50% TFA | 12 g 50% acetic acid 50% TFA |
| TOAF | 0.3 g | X | X | X |
| Ultrasound | ○ | X | X | X |
| Time (min) | Sulfur concentration (ppm) | | | |
| 0 | 8100 | 8100 | 8100 | 8100 |
| 30 | 4543 | | | |
| 60 | 2887 | 1142 | 629 | 320 |
| 90 | | | | 59 |
| 120 | 1990 | 589 | 165 | <15 |
| 180 | 1372 | 388 | <15 | |
| 240 | | <15 | | |
| 360 | 6 | | | |

As shown in Table 3, according to the embodiment 1 and embodiment 2, it is observed that a better desulfurization rate is obtained without using ultrasound stirring and TOAF. When comparing the embodiment 2 and the embodiment 3, increasing the $H_2O_2$ concentration up to 50% can improve the desulfurization efficiency. According to the embodiment 4, the desulfurization efficiency can be further upgraded by modifying the catalyst concentration. In addition, the [S atom]:[O atom] in the embodiment 1 is about 1:50, while [S atom]:[O atom] in the embodiments 2, 3 and 4 are about 1:10, 1:10, and 1:7, which are much closer to the optimized [S atom]:[O atom] ratio 1:2. The embodiments 2, 3 and 4 provide appropriate [S]:[O] ratio in the desulfurization process so the efficiency can be increased.

Figure 4:
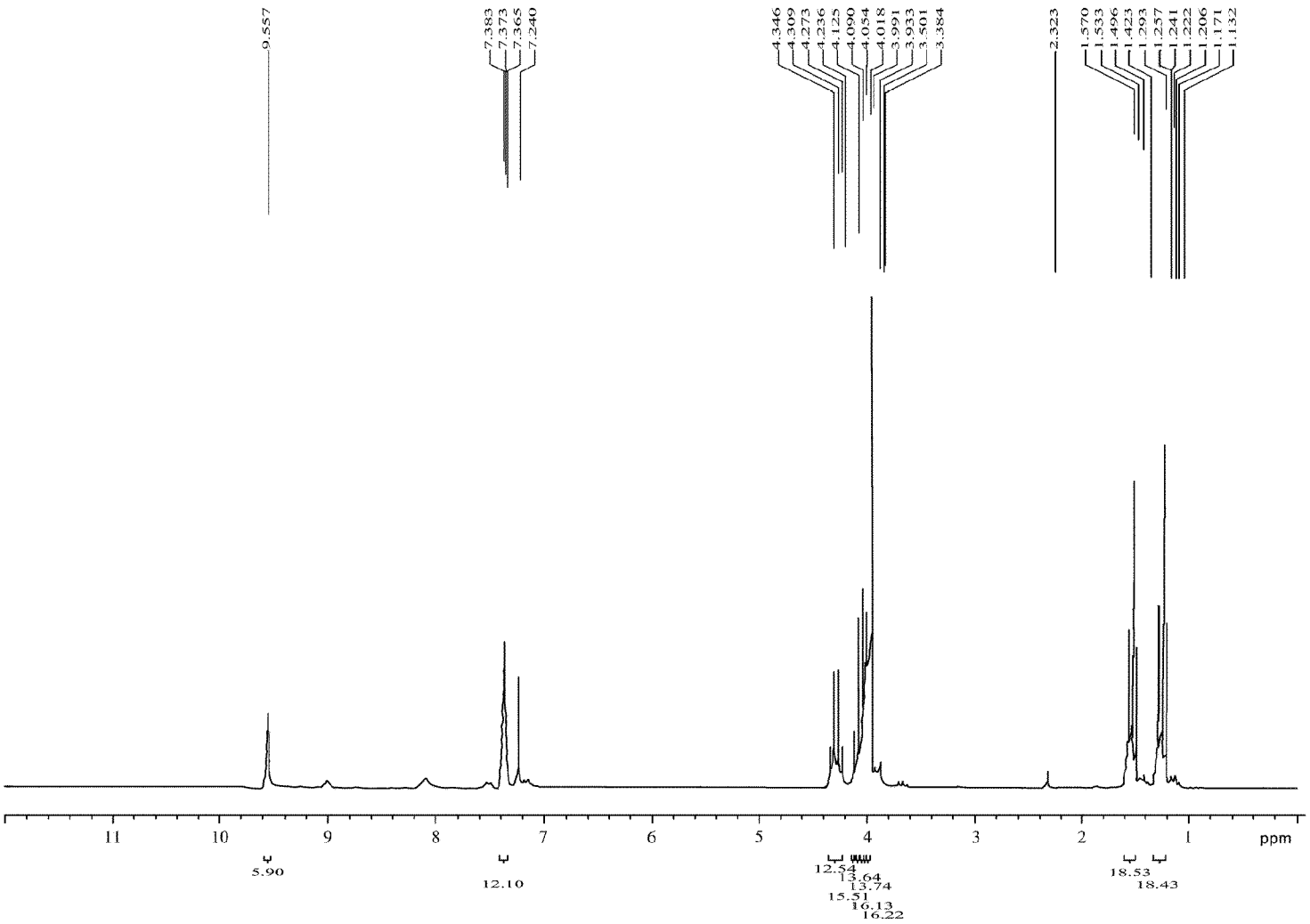
FIG. 4 shows a result of a NMR spectroscopy of an original ionic liquid.
Figure 5:
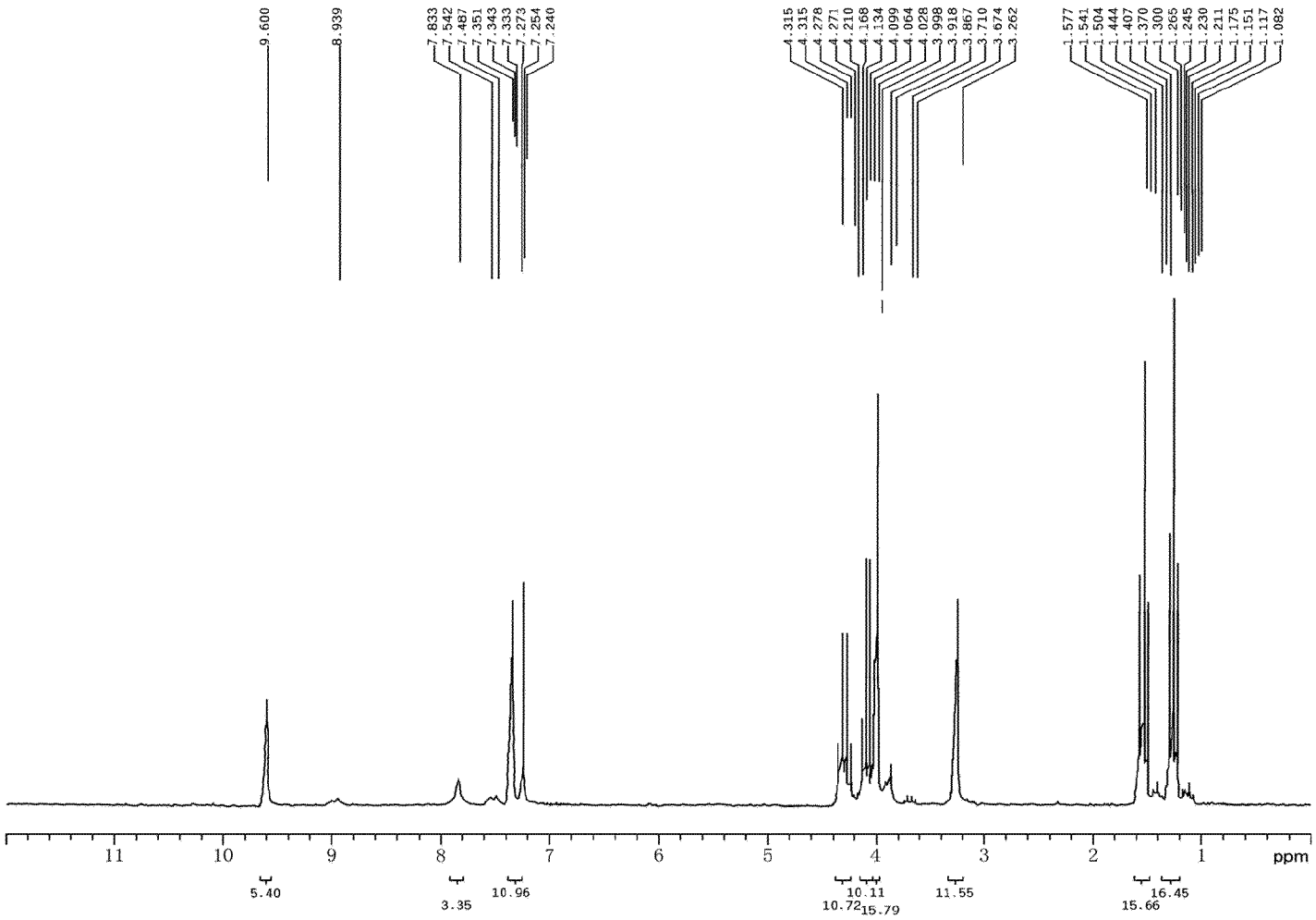
FIG. 5 shows a result of a NMR spectroscopy of a recycled ionic liquid.

The present invention further provides a method of recycling the ionic liquid and the catalyst. FIG. 4 shows a result of a NMR spectroscopy of an original ionic liquid and FIG. 5 shows a result of NMR spectroscopy of a recycled ionic liquid. According to FIG. 4 and FIG. 5, it is shown that the recycled ionic liquid has nearly the same composition as the original ionic liquid one, thereby showing that the recycling method in the present invention is efficient. The inventor further observers that using the recycled ionic liquid in the first step can further upgrade 10%-50% of the desulfurization efficiency. In addition, the present uses the first solution such as deionized water to perform the recycling process, which can be easily obtained and is relatively cheap, thereby saving the operation cost.

It is another salient feature of the present invention that the applied reaction temperature can be as low as the room temperature to achieve the same desulfurization efficiency as in the conventional arts, which is usually performed at a temperature over 70° C. or 100° C. In the present embodiment, it has been observed that effective results can be achieved under a low temperature (30° C.-50° C.) and a similarly low pressure (about 1 atm).

In summary, the present invention provides a more efficient and cost effective fuel desulfurization method which includes various improved features such as a non-mechanical mixer instead of an ultrasonic stirring, recycled ionic liquid, a modified oxidant concentration and a modified acid catalyst.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fuel desulfurization method, comprising:

(a) oxidizing a fuel with an ionic liquid, an oxidant, and an acid catalyst;

(b) mixing the oxidized fuel with a desulfurization agent to form a desulfurized fuel; and (c) recycling the ionic liquid, comprising:

adding a first solution into the ionic liquid after the step (a), and removing a precipitate;

after adding the first solution and removing the precipitate, adding a second solution into the ionic liquid to form a second solution phase and an ionic liquid phase;

removing the second solution phase away; and removing the first solution, the oxidant and the acid catalyst from the remained ionic liquid phase to form a recycled ionic liquid.

2. The fuel desulfurization method as in claim 1, wherein in the step (c) the first solution is deionized water.

3. The fuel desulfurization method as in claim 1, wherein in the step (c) the second solution comprises 1-butanol, chloroform, chlorobenzene, diethyl ether, ethyl acetate, heptane, hexane, triethyl amine or toluene.

4. The fuel desulfurization method as in claim 1, wherein in the step (c) the first solution, the oxidant and the acid catalyst are removed away from the remaining ionic liquid phase by a distillation process.

5. The fuel desulfurization method as in claim 1, wherein the step (c) is performed three times.

6. The fuel desulfurization method as in claim 1, wherein no phase transfer agent is used in the step (a).

7. The fuel desulfurization method as in claim 6, wherein the phase transfer agent is Tetraoctylammonium fluoride (TOAF) or Tetraoctylammonium chloride (TOAC).

8. The fuel desulfurization method as in claim 1, wherein the ionic liquid comprises Tri-Methylammonium Chloroaluminate ($AlCl_3$-TMAC), 1-Ethyl-3-Methylimidazolium Tetrafluoroborate ([EMIM][$BF_4$]), 1-Butyl-3-Methylimidazolium Hexafluorophosphate ([BMIM][$PF_6$]), 1-Butyl-3-Methylimidazolium Tetrafluoroborate ([BMIM][$BF_4$]), 1-Butyl-3-Methylimidazolium Octyl Sulfate ([BMIM][$OcSO_4$]) or 1-Ethyl-3-Methylimidazolium Ethyl Sulfate ([EMIM][$EtSO_4$]).

9. The fuel desulfurization method as in claim 1, wherein the ionic liquid comprises 1,2,3-Trimethylimidazolium methyl sulfate, 1,2,4-Trimethylpyrazolium methylsulfate, 1-Ethyl-2,3-dimethylimidazolium ethyl sulfate, 1-Ethyl-3-methylimidazolium methanesulfonate or 1,3-Dimethylimidazolium methyl sulfate.

10. The fuel desulfurization method as in claim 1, wherein the oxidant comprises hypohalite compound, chlorite, permanganate salt, ammonium cerium (IV) nitrate, hexavalent chromium compound, peroxide compound, Tollen's Reagent, sulfoxide, persulfuric acid, oxygen or ozone.

11. The fuel desulfurization method as in claim 1, wherein the oxidant comprises $H_2O_2$ and in the step (a), the concentration of $H_2O_2$ is substantially between 30% and 50%.

12. The fuel desulfurization method as in claim 1, wherein the acid catalyst comprises acetic acid, tri-fluoro acetic acid, or tri-chloro acetic acid.

13. The fuel desulfurization method as in claim 1, wherein in step (a) the acid catalyst comprises 20%-50% tri-fluoro acetic acid, tri-chloro acetic acid, and 40%-60% acetic acid.

14. The fuel desulfurization method as in claim 1, wherein the fuel desulfurization method is performed under a temperature substantially between 30° C. and 50° C.

15. The fuel desulfurization method as in claim 1, wherein the step (a) is performed without ultrasonic stirring.

16. The fuel desulfurization method as in claim 1, wherein the step (a) comprises using a non-mechanical mixer.

17. The fuel desulfurization method as in claim 16, wherein the non-mechanical mixer comprises a hollow tube with a plurality of protrusions into the hollow tube.

18. The fuel desulfurization method as in claim 16, wherein the non-mechanical mixer does not require driving power.

* * * * *